US010944198B2

(12) United States Patent
Mamiya et al.

(10) Patent No.: US 10,944,198 B2
(45) Date of Patent: Mar. 9, 2021

(54) CONNECTOR

(71) Applicant: Sumitomo Wiring Systems, Ltd., Mie (JP)

(72) Inventors: Yuma Mamiya, Mie (JP); Shinjiro Kida, Mie (JP); Sho Saito, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/675,566

(22) Filed: Nov. 6, 2019

(65) Prior Publication Data

US 2020/0153145 A1 May 14, 2020

(30) Foreign Application Priority Data

Nov. 14, 2018 (JP) ..... JP2018-213439

(51) Int. Cl.

| | |
|---|---|
| ***H01R 3/00*** | (2006.01) |
| ***H01R 13/428*** | (2006.01) |
| ***H01R 13/627*** | (2006.01) |
| *H01R 107/00* | (2006.01) |

(52) U.S. Cl.

CPC ..... *H01R 13/428* (2013.01); *H01R 13/6273* (2013.01); *H01R 2107/00* (2013.01)

(58) Field of Classification Search

CPC ..... H01R 13/428; H01R 13/6273; H01R 2107/00; H01R 13/641; H01R 13/6272

USPC ..... 439/258

See application file for complete search history.

(56) References Cited

U.S. PATENT DOCUMENTS

| | | | | |
|---|---|---|---|---|
| 5,839,915 | A * | 11/1998 | Ford | H01R 13/641 439/489 |
| 6,109,955 | A * | 8/2000 | Hanazaki | H01R 13/641 439/352 |
| 2002/0187673 | A1* | 12/2002 | Kurimoto | H01R 43/26 439/489 |
| 2015/0111406 | A1* | 4/2015 | Okano | H01R 13/6272 439/352 |
| 2015/0349470 | A1* | 12/2015 | Horiuchi | H01R 13/6273 439/353 |
| 2016/0064875 | A1* | 3/2016 | Tanikawa | H01R 13/6275 439/620.21 |

(Continued)

FOREIGN PATENT DOCUMENTS

JP 2017-168247 9/2017

*Primary Examiner* — Abdullah A Riyami
*Assistant Examiner* — Nelson R. Burgos-Guntin
(74) *Attorney, Agent, or Firm* — Gerald E. Hespos; Michael J. Porco; Matthew T. Hespos

(57) ABSTRACT

A lock arm (31) has a lock (34) that rides on a lock projection (62) while connecting two housings (10, 60) and locks the lock projection (62) when the housings (10, 60) are connected. A connection detecting member (45) is movable in the male housing (10) and between an initial position and a detection position. The connection detecting member (45) has a resilient detecting portion (50) capable of contacting the lock (34). First and second restricting surfaces (36, 37) are formed on a facing surface (35) of the lock (34) facing the resilient detecting portion (50). The first restricting surface (36) restricts displacement of the resilient detecting portion (50) in a riding direction on the lock (62) with respect to the lock (34) and the second restricting surface (37) restricts displacement of the resilient detecting portion (50) in a direction opposite to the riding direction on the lock projection (62).

10 Claims, 11 Drawing Sheets

(56) References Cited

U.S. PATENT DOCUMENTS

| | | | | |
|---|---|---|---|---|
| 2016/0336689 | A1* | 11/2016 | Kida | H01R 13/639 |
| 2020/0136311 | A1* | 4/2020 | Narama | H01R 13/6272 |
| 2020/0153145 | A1* | 5/2020 | Mamiya | H01R 13/6272 |
| 2020/0153161 | A1* | 5/2020 | Mamiya | H01R 13/641 |
| 2020/0153162 | A1* | 5/2020 | Mamiya | H01R 13/4223 |
| 2020/0203885 | A1* | 6/2020 | Mase | H01R 13/502 |

* cited by examiner

CONNECTOR

BACKGROUND

Field of the Invention

The invention relates to a connector.

Related Art

Japanese Unexamined Patent Publication No. 2017-168247 discloses a connector with a male housing and a female housing. The female housing is formed with a lock arm and mounted with a CPA member. In a state where the male housing and the female housing are not connected, a CPA lock of the CPA member butts against a female lock of the lock arm from behind. Thus, the CPA member is held at an initial position. In the process of connecting the male and female housings (incompletely connected state), the female lock and the CPA lock successively ride on a beak of the male housing. Thus, the state where the CPA lock portion butts against the female lock portion is maintained.

When the both housings reach a properly connected state, the female lock passes over the male beak, whereas the CPA lock portion is kept on the male beak. Thus, the CPA lock is separated from the female lock. Therefore, if the CPA member is pushed forward in this state, the CPA member moves to a connection guarantee position while the CPA lock is passing over the female lock. In this way, a connected state of the housings can be detected based on whether or not the CPA member can be moved from the initial position to the connection guarantee position.

In the above connector, when the CPA member at the initial position is pushed forward in the state where the housings are not connected, the CPA lock may ride on the female lock or the CPA member may slip under the female lock to move toward the connection guarantee position.

The invention was completed on the basis of the above situation and aims to enable a connection detecting member to be reliably held at an initial position.

SUMMARY

The invention is directed to a connector with a first housing formed with a resiliently deformable lock arm and a second housing formed with a lock projection. A lock is formed on the lock arm and is configured to ride on the lock projection as the lock arm is resiliently deformed in the process of connecting the first and second housings. The lock rides over the lock projection and is locked to the lock projection as the lock arm resiliently returns when the first and second housings are connected properly. A connection detecting member is to be mounted into the first housing and is movable between an initial position and a detection position. A resilient detecting portion is formed on the connection detecting member and is configured to restrict a movement of the connection detecting member from the initial position toward the detection position by contacting the lock. However, the resilient detecting portion allows a movement of the connection detecting member from the initial position to the detection position by being disengaged from the lock. A first restricting surface is formed on a facing surface of the lock facing the resilient detecting portion and is configured to restrict a relative displacement of the resilient detecting portion in a riding direction with respect to the lock. A second restricting surface is formed on the facing surface and is configured to restrict a relative displacement of the resilient detecting portion in a direction opposite to the riding direction with respect to the lock portion.

When the connection detecting member at the initial position is pushed toward the detection position and the resilient detecting portion strongly butts against the lock, even if the resilient detecting portion is going to be displaced in the riding direction with respect to the lock, such a displacement is impeded by the first restricting surface. Further, when the resilient detecting portion is going to be displaced opposite to the riding direction with respect to the lock, such a relative displacement is impeded by the second restricting surface. Thus, the connection detecting member can be held at the initial position.

A clearance may be secured between the first restricting surface and the resilient detecting portion with the connection detecting member held at the initial position. Thus, when the first and second housings are connected properly, the lock can be locked to the lock projection by a resilient restoring force of the lock arm without causing the first restricting surface to interfere with the resilient detecting portion.

The first restricting surface may be inclined with respect to a moving direction of the connection detecting member between the initial position and the detection position. According to this configuration, even if the resilient detecting portion contacts the first restricting surface when the first and second housings are connected properly, the lock can be locked to the lock projection while causing the first restricting surface to slide in contact with the resilient detecting portion by a resilient restoring force of the lock arm.

A clearance may exist between the second restricting surface and the resilient detecting portion with the connection detecting member at the initial position. Thus, the lock can ride on the lock projection without causing the second restricting surface to interfere with the resilient detecting portion in the process of connecting the first and second housings.

The second restricting surface may be inclined with respect to the moving direction of the connection detecting member between the initial position and the detection position. Thus, even if the resilient detecting portion contacts the second restricting surface while connecting the first and second housings, the lock can ride on the lock projection while causing the second restricting surface to slide in contact with the resilient detecting portion.

The resilient detecting portion may be a resiliently deformable arm cantilevered in a moving direction from the initial position to the detection position. An extending end part of the resilient detecting portion serves as a butting surface capable of contacting the facing surface. Low rigidity portions spaced apart in an extending direction of the resilient detecting portion may be formed in a region of the resilient detecting portion between a base end part and the butting surface. According to this configuration, when the resilient detecting portion is deflected resiliently, stress is distributed to the low rigidity portions to prevent breakage of the resilient detecting portion.

DETAILED DESCRIPTION

An embodiment of the invention is described with reference to FIGS. 1 to 11. Note that, in the following description, a left side in FIGS. 1 and 3 to 11 is defined as a front side concerning a front-rear direction. Upper and lower sides shown in FIGS. 1 to 4, 10 and 11 are defined as upper and lower sides concerning a vertical direction. A lower side in FIGS. 5 to 9 is defined as a left side concerning a lateral direction.

Figure 4:
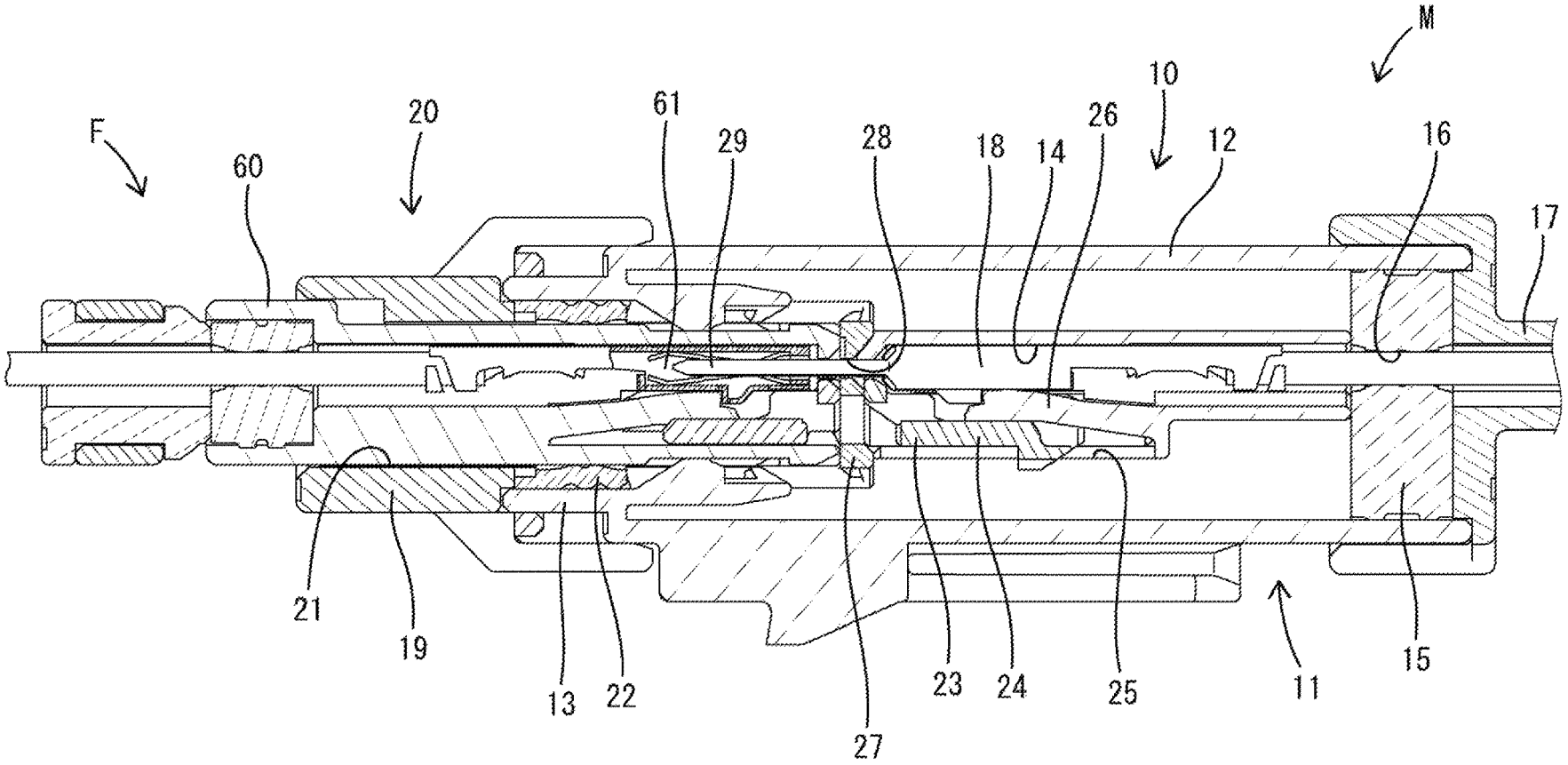
FIG. 4 is a side view in section showing a connected state of the male housing (first housing) and a female housing (second housing).
Figure 5:
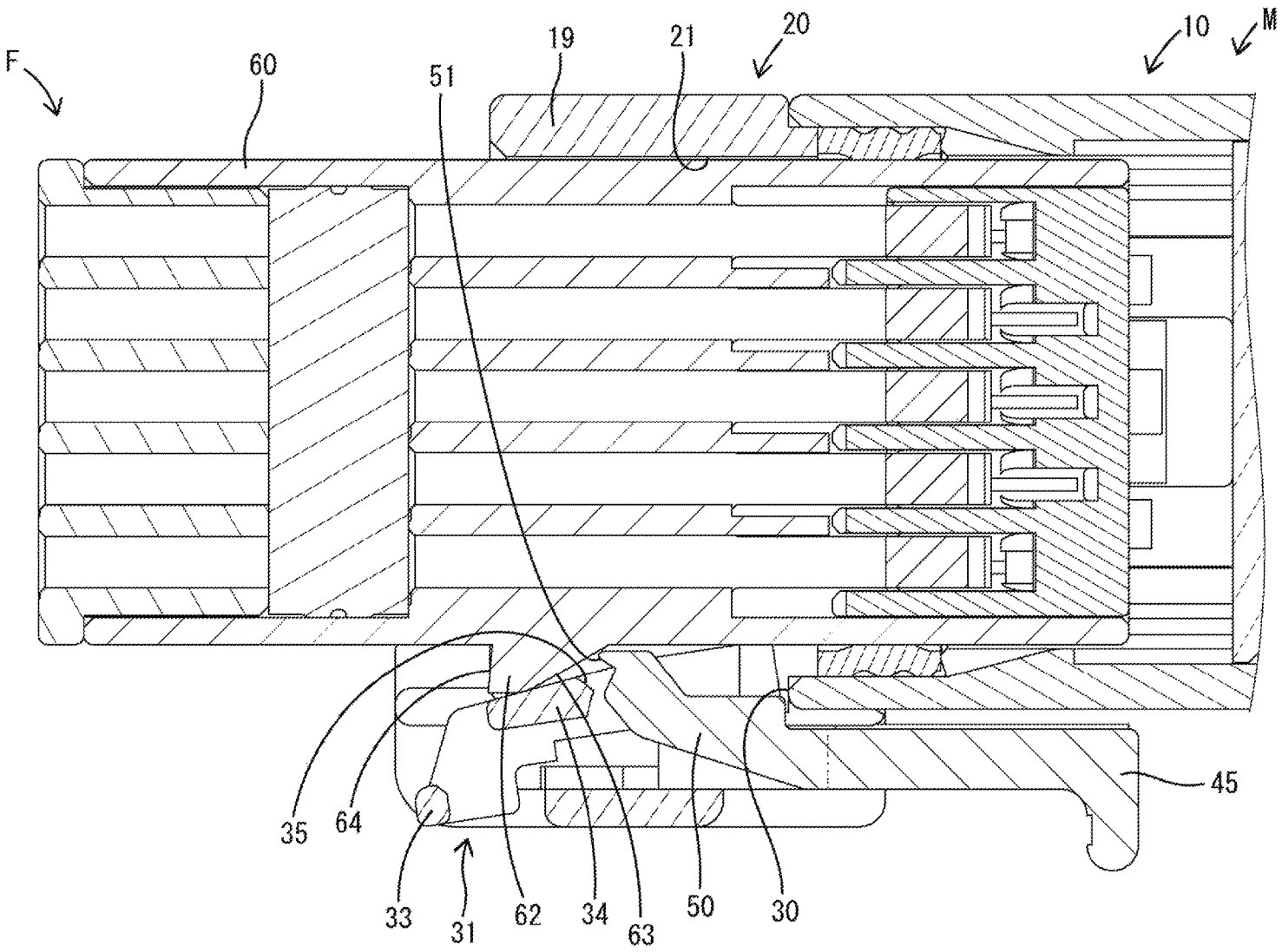
FIG. 5 is a plan view in section showing a connecting process of the both housings.
Figure 6:
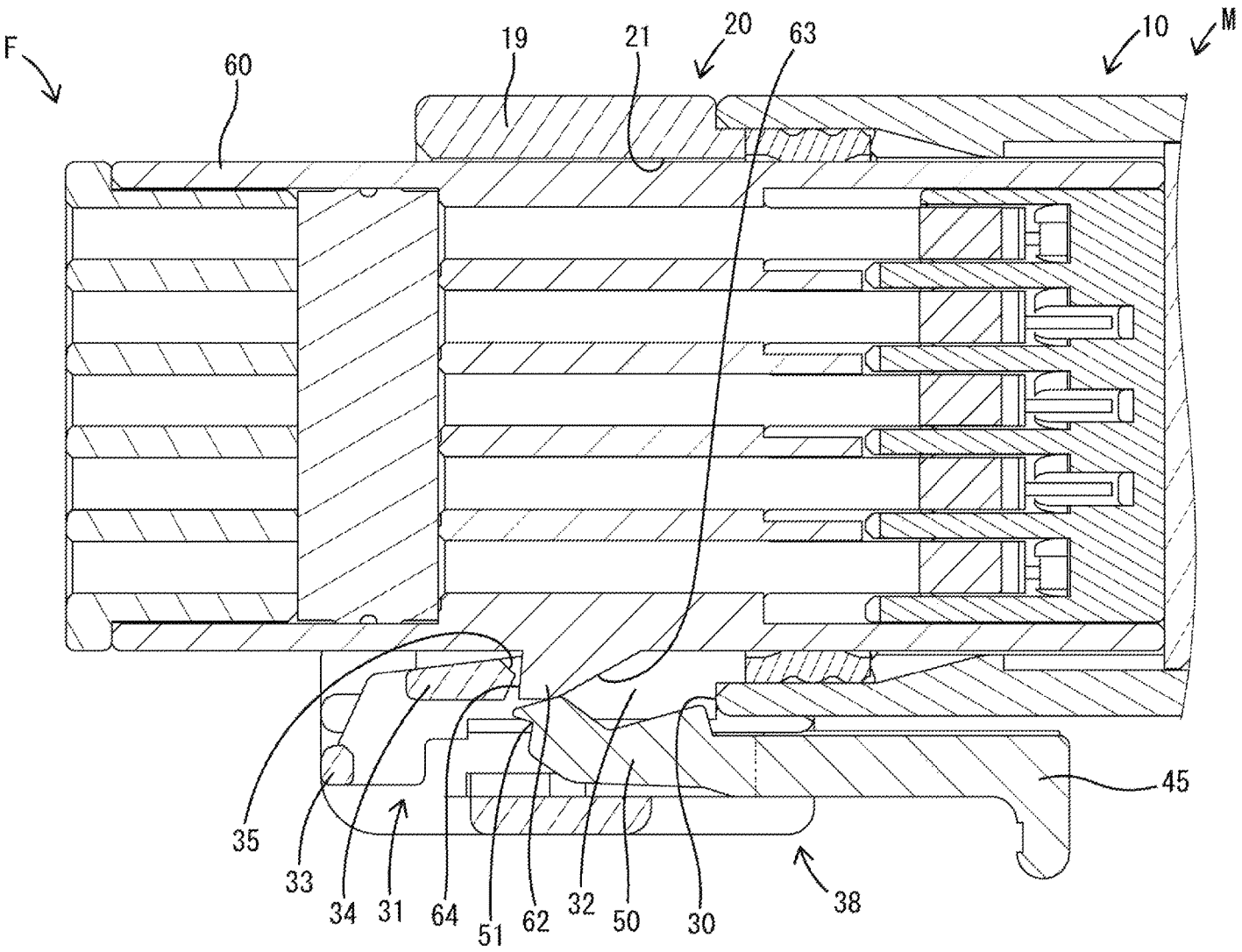
FIG. 6 is a plan view in section showing the housings connected properly.
Figure 7:
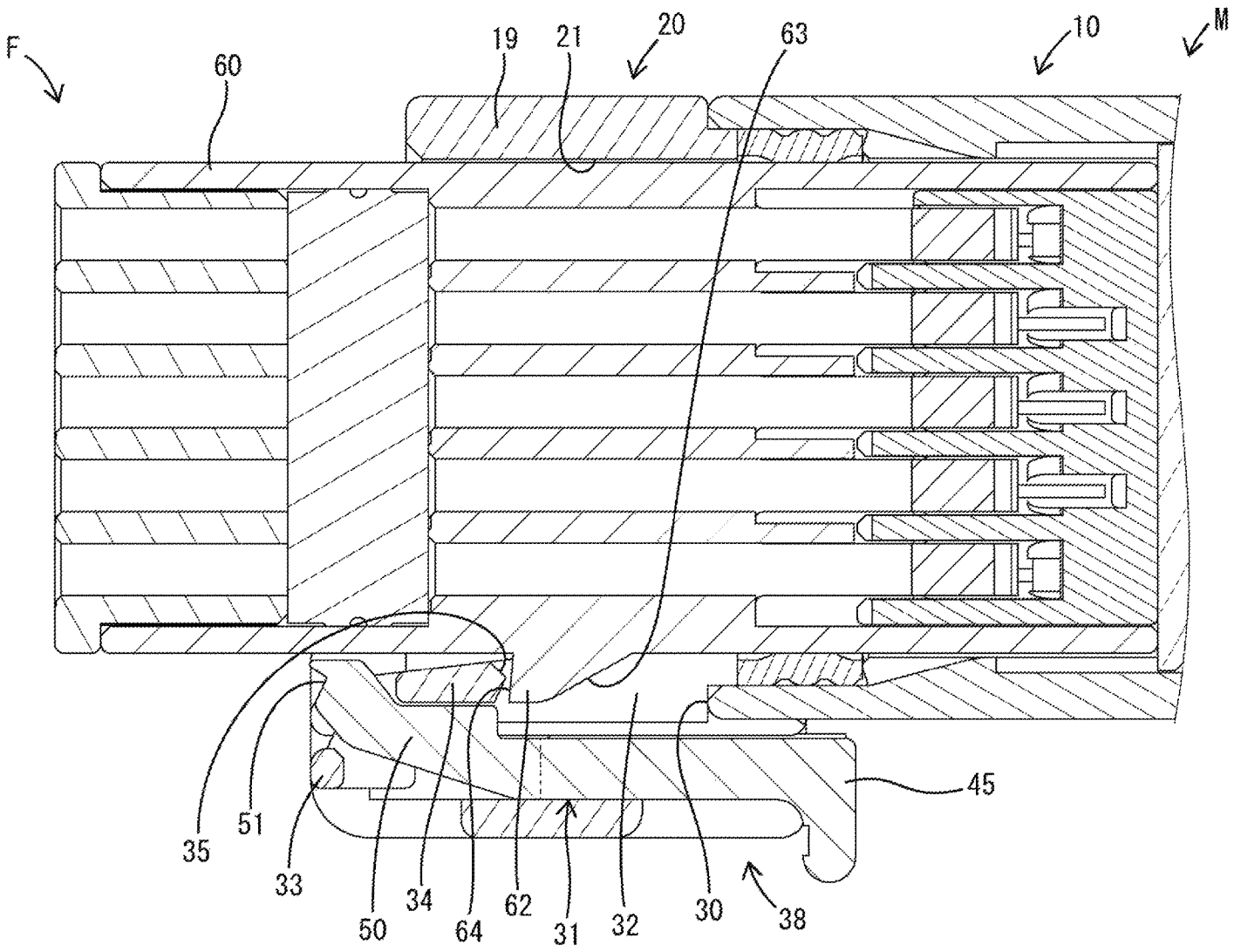
FIG. 7 is a plan view in section showing a state reached by moving a connection detecting member to a detection position.

A connector of this embodiment includes a female connector F and a male connector M. The female connector F is a block long in the front-rear direction. As shown in FIG. 4, the female connector F has a female housing 60 (second housing as claimed) that accommodates female terminal fittings 61 in parallel in the lateral direction. As shown in FIGS. 5 to 7, a lock projection 62 is formed on an outer side surface of the female housing 60. The lock projection 62 has a trapezoidal shape with unequal sides in a plan view.

The lock projection 62 has a guiding surface 63 facing a connecting direction to the male connector M and inclined with respect to the connecting direction to the male connector M. A lock surface 64 is formed on the lock projection 62 opposite to the guiding surface 63 in the connecting direction and is substantially at a right angle to the connecting direction.

Figure 1:
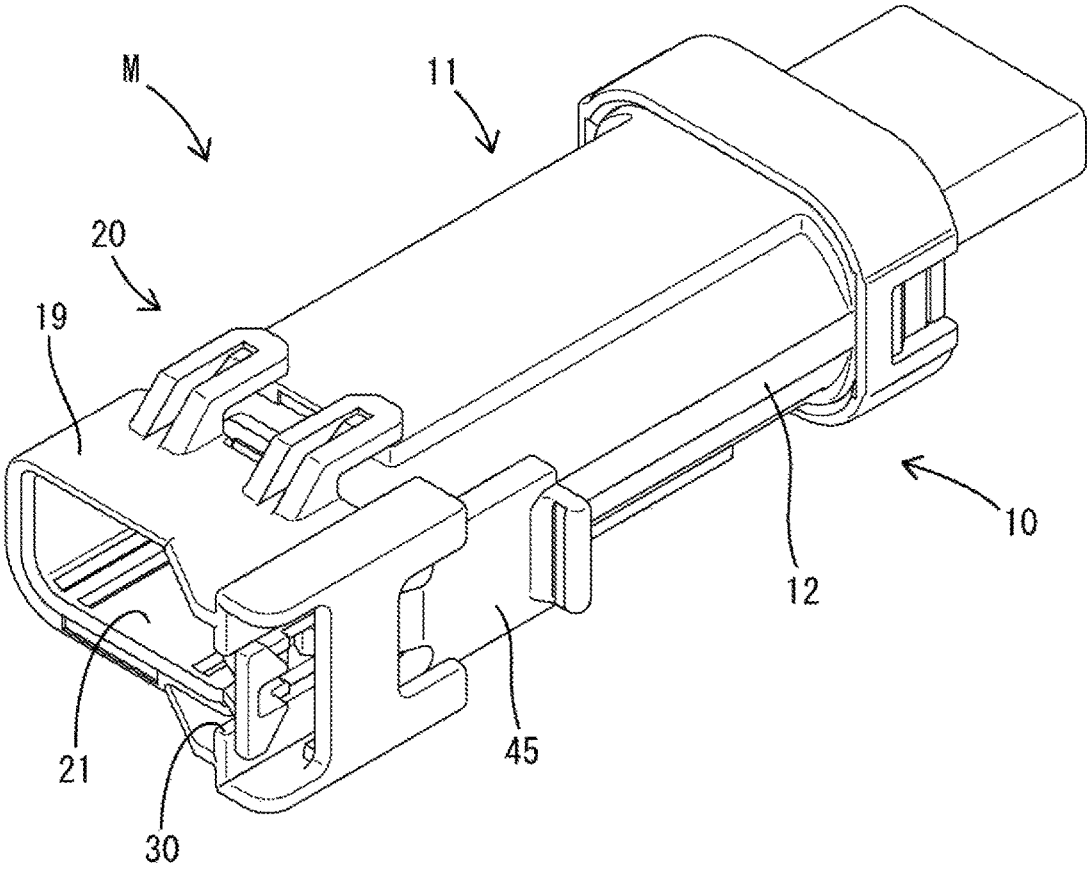
FIG. 1 is a perspective view of a male housing (first housing) of one embodiment.
Figure 2:
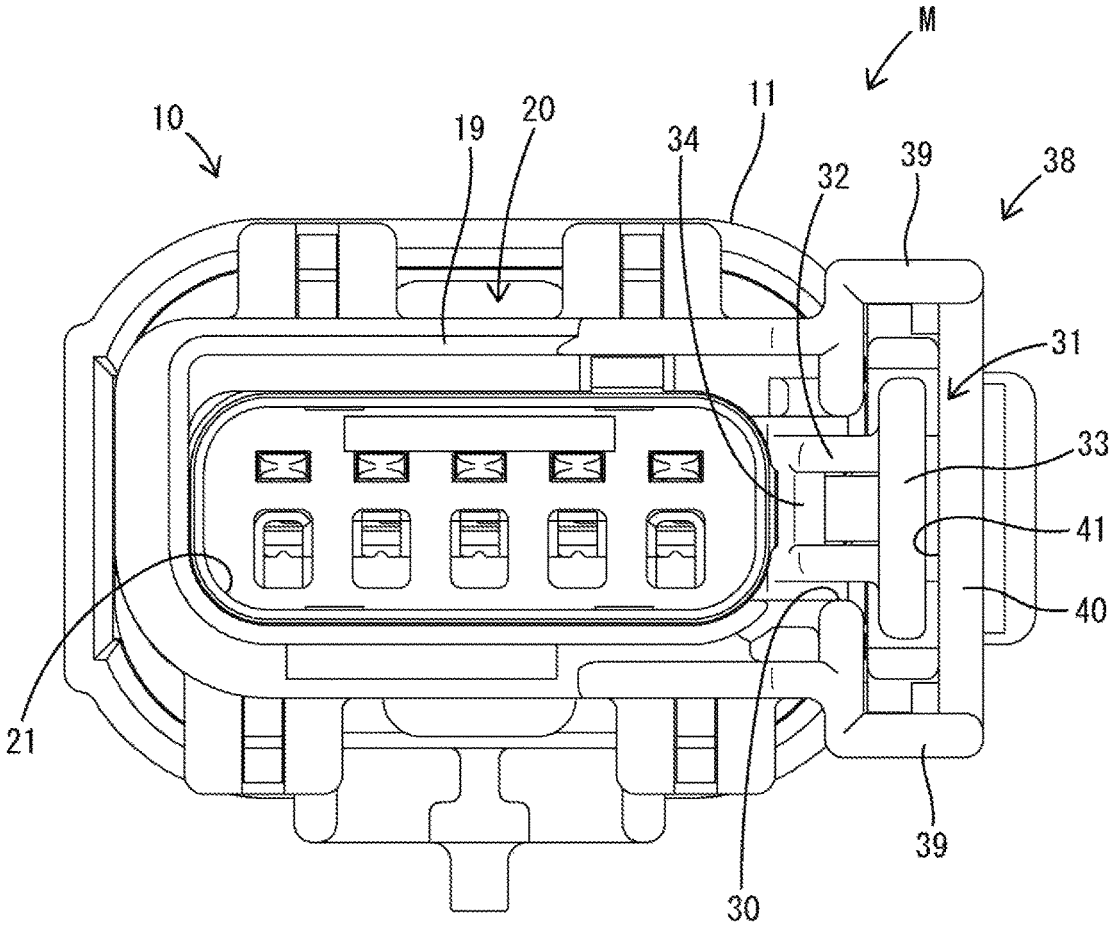
FIG. 2 is a front view of the male housing (first housing).
Figure 3:
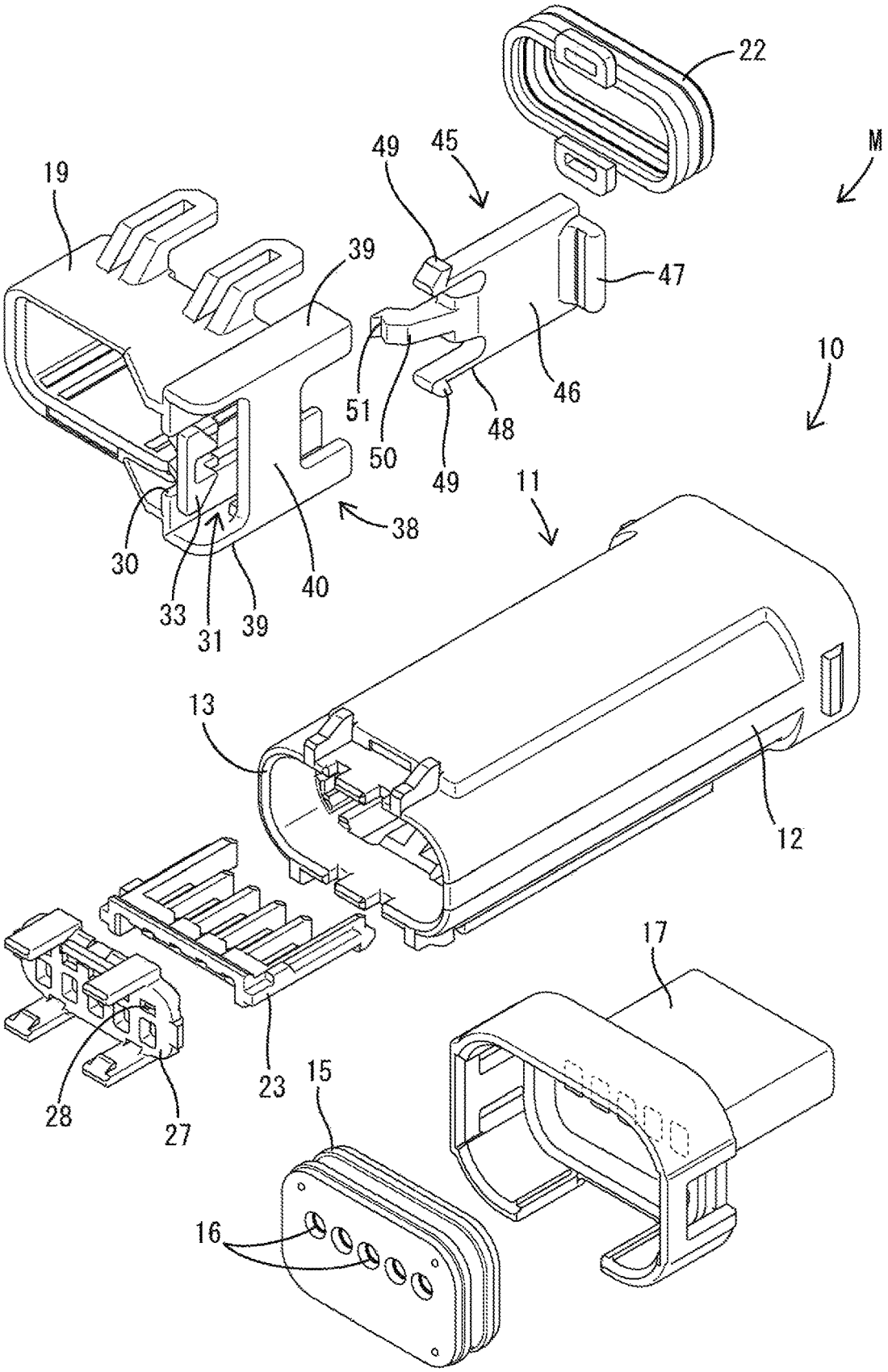
FIG. 3 is an exploded perspective view of the male housing (first housing).

As shown in FIG. 3, the male connector M includes a male housing 10 (first housing as claimed), a one-piece rubber plug 15, a rear holder 17, male terminal fittings 18, a retainer 23 and a moving plate 27. The male housing 10 is configured by assembling a housing body 11 made of synthetic resin, a front receptacle 19, a connection detecting member 45 and a seal ring 22. The housing body 11 is a single member including a terminal holding portion 12 and a tubular portion 13 projecting forward from the outer periphery of a front part of the terminal holding portion 12.

Terminal accommodation chambers 14 are formed in the terminal holding portion 12 and are arranged in parallel in the lateral direction. As shown in FIG. 4, the rubber plug 15 is mounted in a rear part of the housing body 11 and includes sealing holes 16 individually corresponding to the respective terminal accommodation chambers 14. The one-piece rubber plug 15 is held in the housing body 11 by the rear holder 17 mounted on the housing body 11. The male terminal fittings 18 passed through the sealing holes 16 from behind the housing body 11 are inserted respectively into each terminal accommodation chambers 14. The male terminal fittings 18 inserted into the terminal accommodation chambers 14 are retained and locked by a primary locking action of a locking lance 26.

As shown in FIGS. 1 and 4 to 7, the tubular front receptacle 19 is coaxially mounted on a front part of the housing body 11 (tubular portion 13). By assembling the front receptacle 19 with the tubular portion 13 to configure a receptacle 20 of the male housing 10. An internal space of the receptacle 20 serves as a fitting space 21 into which the female connector F is fit from the front of the male housing 10. The retainer 23 and the moving plate 27 are accommodated in the fitting space 21.

The retainer 23 is mounted in a front part of the terminal holding portion 12. The retainer 23 is movable in the front-rear direction between a partial locking position where the male terminal fittings 18 can be inserted into and withdrawn from the terminal accommodation chambers 14 and a full locking position behind the partial locking position. Deflection restricting portions 24 of the retainer 23 enter deflection spaces 25 for the locking lances 26 as the retainer 23 moves to the full locking position to restrict the deformation of the locking lances 26. The male terminal fittings 18 are retained reliably in the terminal accommodation chambers 14 by a secondary locking action of this retainer 23 (see FIG. 4).

The moving plate 27 is accommodated in the receptacle 20 to face the front surface of the retainer 23 and is movable in the front-rear direction between a standby position and a connection position behind the standby position. Positioning holes 28 penetrate the moving plate 27 in the front-rear direction. A tab 29 of the male terminal fitting 18 is passed through the positioning hole 28 to be positioned in directions perpendicular to the connecting direction of the connectors F, M (moving direction of the moving plate 27).

Figure 10:
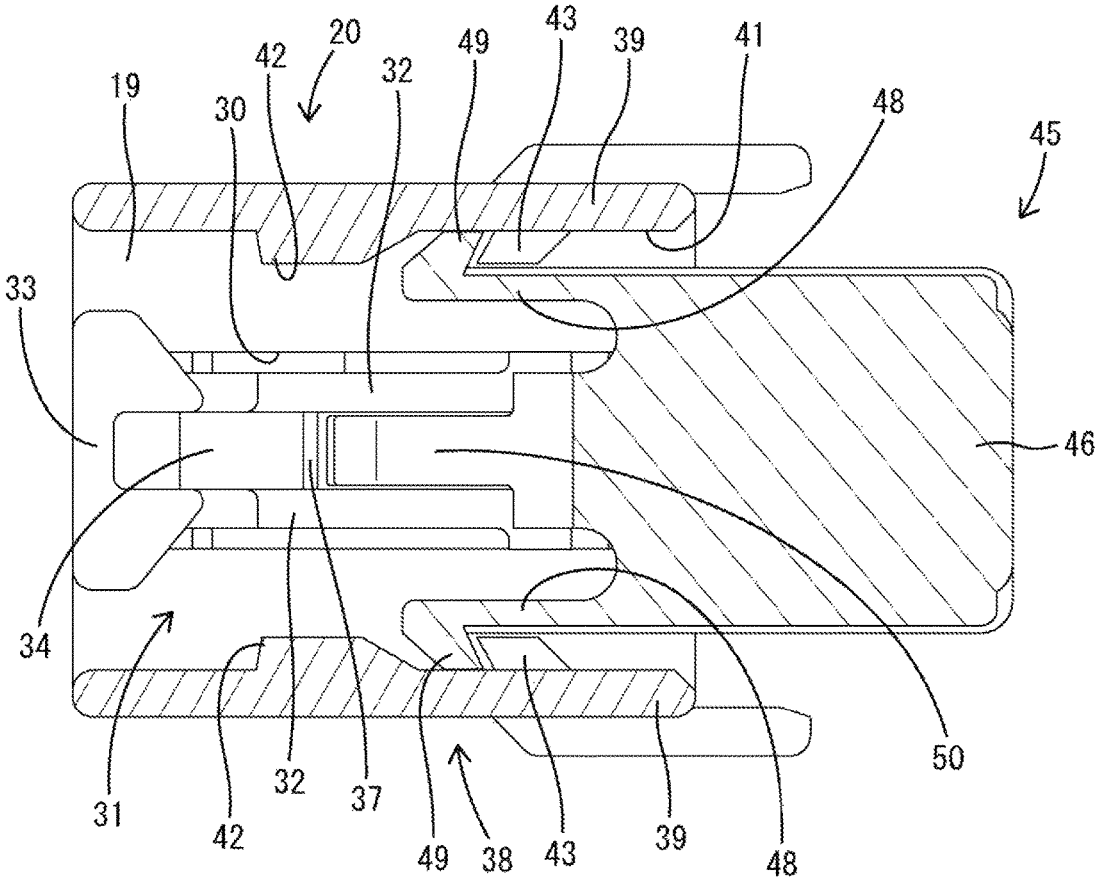
FIG. 10 is a side view in section showing the state where the connection detecting member is held at the initial position.

As shown in FIG. 3, the receptacle 20 is formed with a cutout 30 by cutting a part of a left outer wall of the front receptacle 19. The cutout 30 is open in both front and rear ends of the receptacle 20 (front receptacle 19). A lock arm 31 is formed integrally to correspond to an opening area of the cutout 30 in the receptacle 20 (front receptacle 19). As shown in FIG. 10, the lock arm 31 includes upper and lower arms 32, an operating portion 33 and a lock 34. The arm portions 32 are cantilevered forward from a rear end part of an opening of the cutout 30. The operating portion 33 couples front parts of the arms 32.

Figure 8:
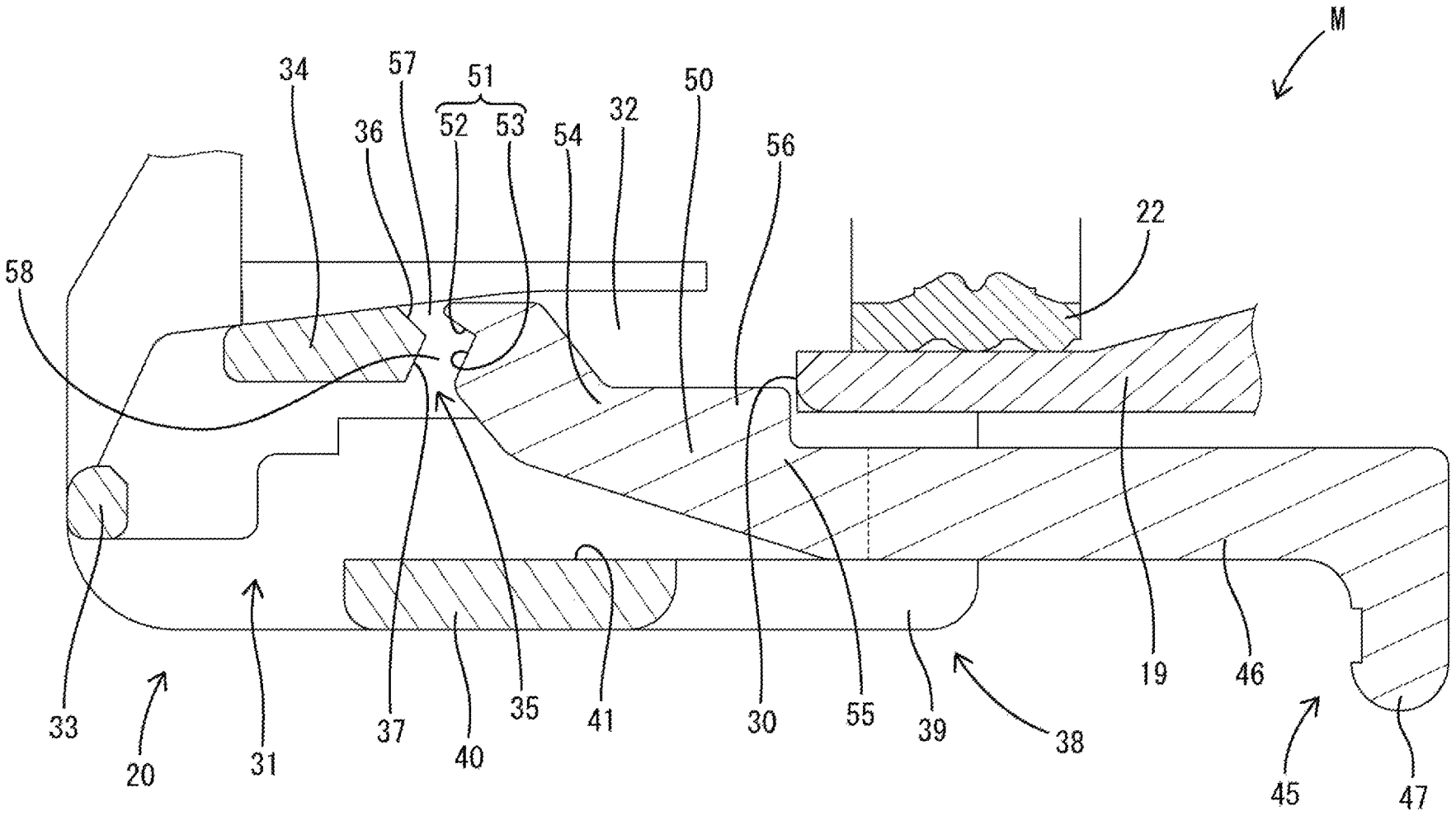
FIG. 8 is a partial enlarged plan view in section showing a state where the connection detecting member is held at an initial position.
Figure 9:
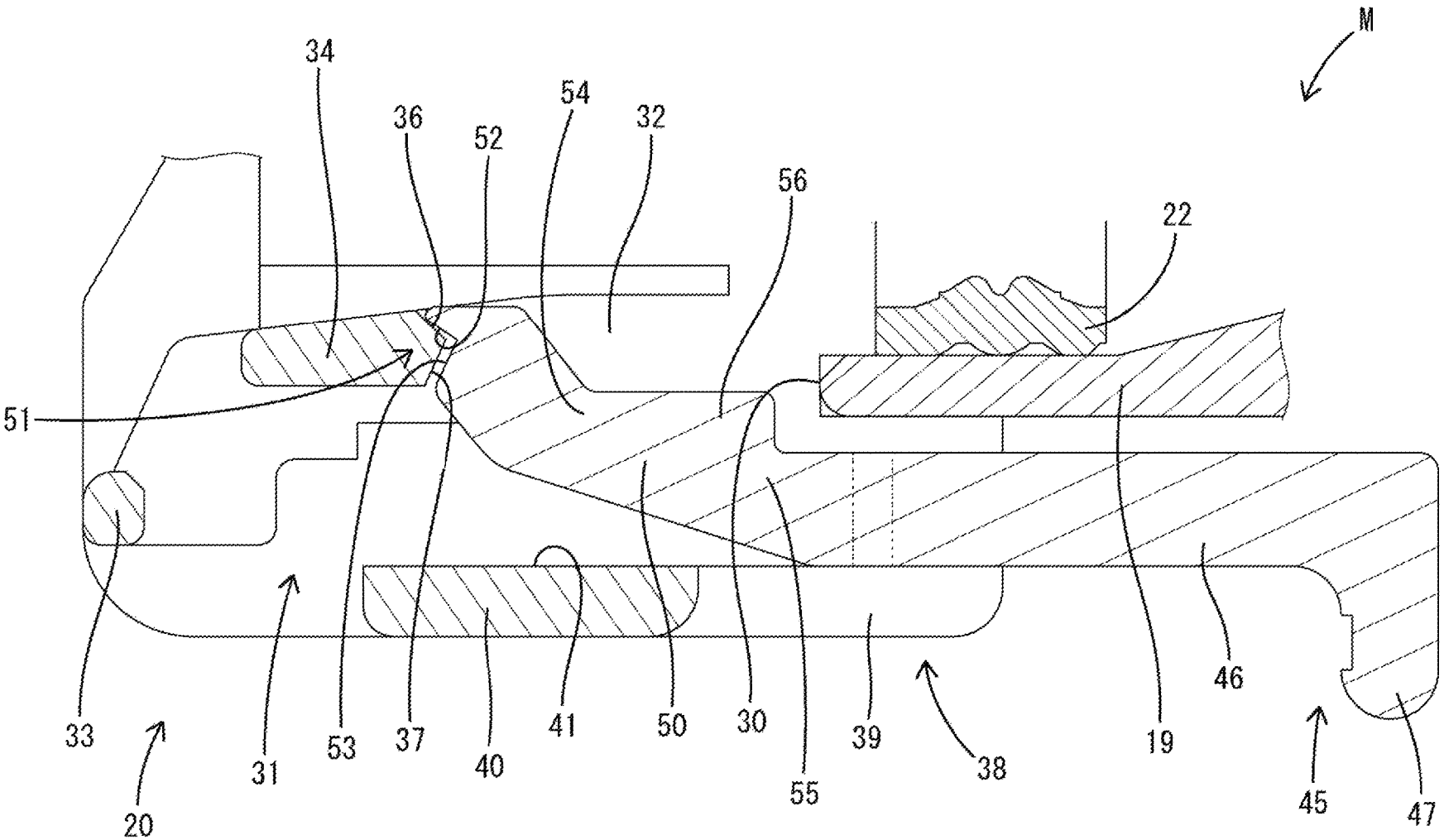
FIG. 9 is a partial enlarged plan view in section showing a butting surface of the connection detecting member in contact with a receiving surface (facing surface) of a lock.

The lock 34 couples parts of inner side surfaces of the arms 32 facing each other slightly behind the operating portion 33. The rear surface of the lock 34 serves as a receiving surface 35 (facing surface as claimed) capable of facing a resilient detecting portion 50 of the connection detecting member 45 to be described later. As shown in FIGS. 8 and 9, the receiving surface 35 has a pointed wedge shape (triangular shape) in a plan view.

The receiving surface 35 is composed of a first restricting surface 36 and a second restricting surface 37. The first restricting surface 36 is a flat surface inclined with respect to the front-rear direction (direction parallel to a moving direction of the connection detecting member 45 to be described later). In the lateral direction, the first restricting surface 36 is formed in a region of the receiving surface 35 on the side of the fitting space 21. The first restricting surface 36 is inclined to face obliquely rearward toward the fitting space 21.

The second restricting surface 37 is a flat surface inclined with respect to the front-rear direction. In the lateral direction, the second restricting surface 37 is formed in a region of the receiving surface 35 opposite the fitting space 21. The second restricting surface 37 faces oblique rearward toward a side laterally opposite to the fitting space 21.

Figure 11:
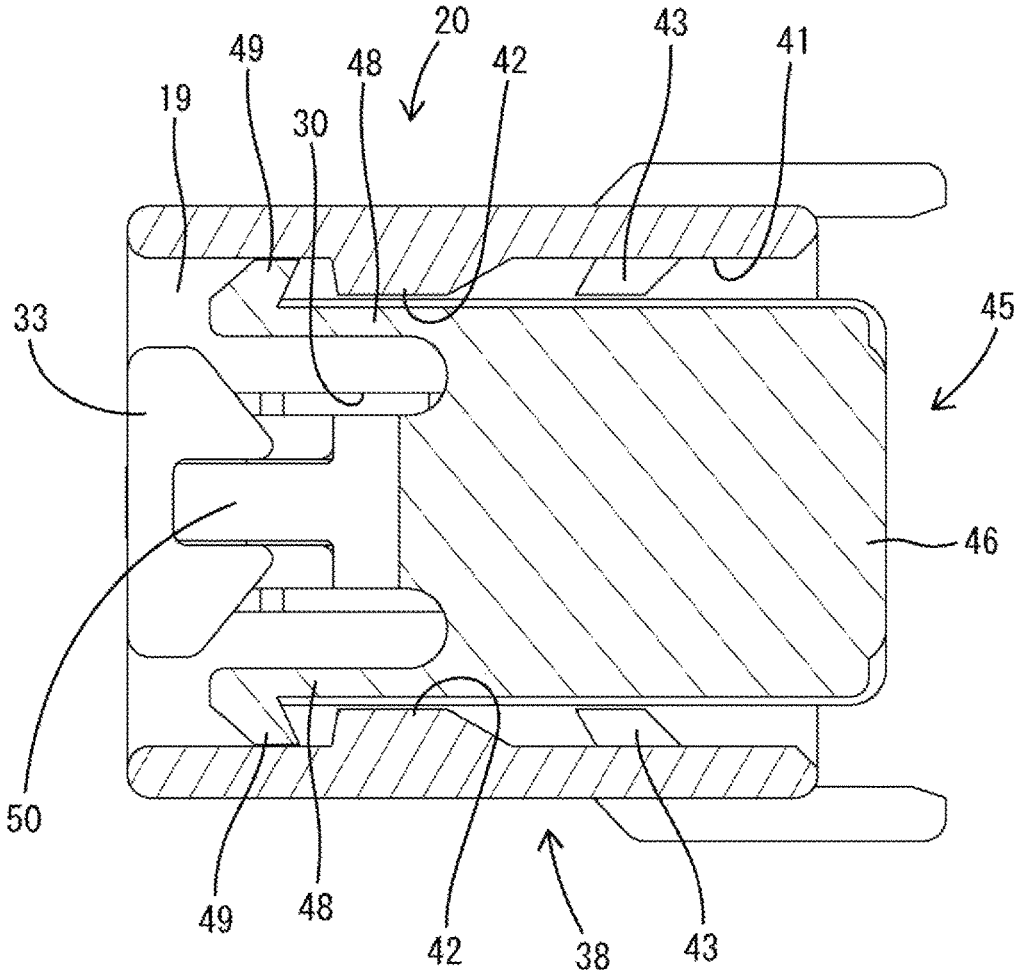
FIG. 11 is a side view in section showing a state where the connection detecting member is held at the detection position.

As shown in FIGS. 3, 10 and 11, the receptacle 20 is integral with a guide 38. The guide 38 includes upper and lower supports 39 and a coupling 40. The supports 39 project leftward substantially at a right angle from both upper and lower end edges of the left outer wall of the front receptacle 19. The coupling 40 couples central parts in the front-rear direction on the projecting end edges of the both upper and lower supports 39. A space defined by the guide 38 and a left wall of the front receptacle 19 serves as a guide space 41 open in the front-rear direction of the guide 38 and toward the fitting space 21. Common projections 42 and retaining projections 43 located behind the common position 42 are formed on the inner surfaces of the upper and lower supports 39 facing each other.

The connection detecting member 45 is mounted into the guide 38. As shown in FIG. 3, the connection detecting member 45 is a single member including a base 46, a grip 47, upper and lower resilient contact pieces 48 and the resilient detecting portion 50. The base 46 is a flat plate whose plate thickness direction is oriented in the lateral direction. The grip 47 is a rib projecting from the rear edge of the base 46. The upper and lower resilient contact pieces 48 are cantilevered forward from upper and lower ends of the front end of the base 46. A locking projection 49 is formed on a front part of each resilient contact piece 48.

The connection detecting member 45 is accommodated in the guide space 41 and movable in the front-rear direction between an initial position (see FIGS. 5, 6 and 8 to 10) and a detection position (see FIGS. 7 and 11) forward of the initial position. As shown in FIG. 10, the connection detecting member 45 is held at the initial position by fitting the locking projections 49 of the resilient contact pieces 48 between the retaining projections 43 and the common projections 42. Further, as shown in FIG. 11, the connection detecting member 45 is held at the detection position by locking the locking projections 49 to front parts of the common projections 42.

The resilient detecting portion 50 is cantilevered forward from a vertically central part of the front of the base 46. In a plan view, the resilient detecting portion 50 extends oblique to the moving direction of the connection detecting member 45 between the initial position and the detection position. The resilient detecting portion 50 is inclined to approach the fitting space 21 from a rear part toward a front part (extending end part).

The front surface (extending end surface) of the resilient detecting portion 50 serves as a butting surface 51 capable of facing the receiving surface 35 of the lock 34. As shown in FIGS. 5 to 9, the butting surface 51 has a recessed triangular shape in a plan view and is composed of first and second contact surfaces 52 and 53.

The first contact surface 52 is constituted by a flat surface inclined with respect to the front-rear direction (direction parallel to the moving direction of the connection detecting member 45). In the lateral direction, the first restricting surface 36 is formed in a region of the butting surface 51 on the side of the fitting space 21. The first contact surface 52 is inclined to face obliquely forward toward a side opposite to the fitting space 21.

The second contact surface 53 is a flat surface inclined with respect to the front-rear direction. In the lateral direction, the second contact surface 53 is formed in a region of the butting surface 51 on a side opposite to the fitting space 21. The second contact surface 53 is inclined to face obliquely forward toward the fitting space 21.

As shown in FIGS. 8 and 9, a tip-side low rigidity portion 54, a high rigidity portion 56 and a base-end-side low rigidity portion 55 are formed in a region of the resilient detecting portion 50 between the front part (butting surface 51) and the rear end part (base end part). The tip-side low rigidity portion 54 is at a position in front of a central part of the resilient detecting portion 50 in the front-rear direction and behind the butting surface 51. The tip-side low rigidity portion 54 is formed by recessing a surface of the resilient detecting portion 50 facing toward the fitting space 21 at an obtuse angle in a plan view.

An interval in the front-rear direction between the rear end surface of the common projection 42 and the front surface of the retaining projection 43 is larger than a dimension of the locking projection 49 in the front-rear direction. The initial position of the connection detecting member 45 is in a range equivalent to the above dimensional difference. Thus, with the connection detecting member 45 located at a rearmost end of the initial position, clearances 57, 58 are formed in the front-rear direction between the butting surface 51 and the receiving surface 35, as shown in FIG. 8.

Specifically, the first restricting surface 36 and the first contact surface 52 are substantially parallel and positioned to face each other across the first clearance 57 in the front-rear direction. Further, the second restricting surface 37 and the second contact surface 53 are substantially parallel and positioned to face each other across the second clearance 58 in the front-rear direction. Further, if the connection detecting member 45 moves to a front end of the initial position, the first contact surface 52 butts against the first restricting surface 36 from behind and the second contact surface 53 butts against the second restricting surface 37 from behind.

The base-end-side low rigidity portion 55 is behind the central part of the resilient detecting portion 50 in the front-rear direction and forward of the base of the resilient detecting portion 50. The base-end-side low rigidity portion 55 is formed by recessing a surface of the resilient detecting portion 50 facing the fitting space 21 at a right angle in plan view. A region of the resilient detecting portion 50 between the tip-side low rigidity portion 54 and the base-end-side low rigidity portion 55 functions as the high rigidity portion 56.

The tip-side low rigidity portion 54 and the base-end-side low rigidity portion 55 have a smaller thickness in the lateral direction (vertical direction in FIGS. 8 and 9) than the front part of the resilient detecting portion 50, the high rigidity portion 56 and the base of the resilient detecting portion 50. Thus, flexural rigidities of the tip-side low rigidity portion 54 and the base-end-side low rigidity portion 55 in the lateral direction are smaller than those of the front part of the resilient detecting portion 50, the high rigidity portion 56 and the base of the resilient detecting portion 50.

Next, functions of this embodiment are described. With the male connector M and the female connector F separated, the butting surface 51 of the connection detecting member 45 is proximately facing the receiving surface 35 of the lock arm 31 from behind. If a pressing force acts on the connection detecting member 45 from behind, the connection detecting member 45 slightly moves forward and the butting surface 51 contacts the receiving surface 35 of the lock arm 31. In this way, a movement of the connection detecting member 45 from the initial position toward the detection position is restricted.

If a large pressing force acts on the connection detecting member 45 from behind with the butting surface 51 held in contact with the receiving surface 35, the resilient detecting portion 50 deflects resiliently and the butting surface 51 may disengage from the receiving surface 35. However, the receiving surface 35 is formed with the first and second restricting surfaces 36, 37 inclined with respect to the moving direction of the connection detecting member 45 and the wedge-shaped rear part of the lock portion 34 bites into the butting surface 51. Thus, the butting surface 51 does not disengage from the receiving surface 35 and the connection detecting member 45 is held reliably at the initial position.

Specifically, if the butting surface 51 is going to be displaced toward the fitting space 21 (in a direction opposite to a riding direction of the resilient detecting portion 50 on the lock projection 62) with respect to the receiving surface 35, the second contact surface 53 is locked to the second restricting surface 37 from the left. Thus, the butting surface 51 is not displaced toward the fitting space 21. Further, if the butting surface 51 is going to be displaced toward a side laterally opposite to the fitting space 21 (in the riding direction of the resilient detecting portion 50 on the lock projection 62) with respect to the receiving surface 35, the first contact surface 52 is locked to the first restricting surface 36 from the right. Thus, the front (butting surface 51) of the resilient detecting portion 50 is not displaced in a direction away from the fitting space 21.

In connecting the male connector M and the female connector F, the moving plate 27 is held at the standby position and the connection detecting member 45 is held at the initial position. In this state, the female connector F is fit into the receptacle 20 (fitting space 21) from the front of the male housing 10. In the process of connecting the connectors F, M, the lock arm 31 is resiliently deflected leftward away from the female housing 60 in the fitting space 21 and the lock 34 rides on the lock projection 62, as shown in FIG. 5. When the lock portion 34 starts riding on the lock projection 62, the front part of the resilient detecting portion 50 has not reached the lock projection 62 yet, and the resilient detecting portion 50 is not deflected.

When the lock 34 starts riding on the lock projection 62, a height difference is created between the lock 34 (receiving surface 35) and the front butting surface 51 of the resilient detecting portion 50 in the lateral direction. However, the first and second clearances 57, 58 are secured between the butting surface 51 and the receiving surface 35. Thus, the lock 34 can be displaced smoothly leftward with respect to the resilient detecting portion 50 (butting surface 51) and ride on the lock projection 62.

Further, even if the butting surface 51 is in contact with the receiving surface 35 when the lock 34 starts riding on the lock projection 62, the front of the resilient detecting portion 50 cannot ride on the lock projection 62 due to interference with the guiding surface 63 of the lock projection 62 and the clearances 57, 58 are created between the butting surface 51 and the receiving surface 35. If the front of the resilient detecting portion 50 slides on the guiding surface 63 with the butting surface 51 held in contact with the receiving surface 35, the second restricting surface 37 and the second contact surface 53 slide in contact with each other in the riding process of the lock 34 on the lock projection 62. Thus, the lock 34 can be displaced smoothly leftward with respect to the resilient detecting portion 50 (butting surface 51). Therefore, the lock 34 does not hinder a riding movement of the lock 34 on the lock projection 62.

When the connectors F, M are connected properly, the lock 34 passes over the lock projection 62, as shown in FIG. 6. Thus, the lock arm 31 resiliently returns. Associated with this, the lock 34 is displaced toward the fitting space 21 and locked to the lock surface 64 from the front to lock the connectors F, M in the connected state.

After the connectors F, M are connected properly, the connection detecting member 45 is moved from the initial position to the detection position by gripping the grip portion 47. In the process of moving the connection detecting member 45, the front of the resilient detecting portion 50 successively rides on the lock projection 62 and the lock 34. When the connection detecting member 45 reaches the detection position, as shown in FIG. 7, the front of the resilient detecting portion 50 passes over the lock 34 and the resilient detecting portion 50 resiliently returns.

If an attempt is made to push the connection detecting member 45 toward the detection position in a state where the connectors F, M are in an incompletely connected state (see FIG. 5), the butting surface 51 of the resilient detecting portion 50 butts against the receiving surface 35 when the connection detecting member 45 slightly moves to restrict further movement of the connection detecting member 45. At this time, the first contact surface 52 contacts the first restricting surface 36, the second contact surface 53 contacts the second restricting surface 37 and the wedge-shaped rear part of the lock 34 bites into the butting surface 51 of the resilient detecting portion 50. Thus, there is no possibility that the front of the resilient detecting portion 50 is disengaged from the lock 34.

As just described, after the connectors F, M are connected, whether the connectors F, M are in the properly connected state or in the incompletely connected state can be detected based on whether or not the connection detecting member 45 can be pushed from the initial position to the detection position.

The connector includes the male housing 10 formed with the resiliently deformable lock arm 31, and the female housing 60 formed with the lock projection 62. The lock arm 31 is formed with the lock 34. In the process of connecting the male housing 10 and the female housing 60, the lock 34 rides on the lock projection 62 as the lock arm 31 is deformed resiliently. When the male and female housings 10 and 60 are connected properly, the lock 34 rides over the lock projection 62 and is locked to the lock projection 62 as the lock arm 31 resiliently returns.

The connection detecting member 45 is mounted into the male housing 10 and is movable between the initial position and the detection position. Further, the connection detecting member 45 is formed with the resilient detecting portion 50. The resilient detecting portion 50 restricts a movement of the connection detecting member 45 from the initial position toward the detection position by contact the lock 34. Further, by disengaging the front part of the resilient detecting portion 50 from the lock 34, the connection detecting member 45 is allowed to move from the initial position to the detection position.

The first and second restricting surfaces 36, 37 are formed on the receiving surface 35 of the lock 34 facing the resilient detecting portion 50. The first restricting surface 36 restricts a relative displacement of the resilient detecting portion 50 in the riding direction on the lock projection 62 with respect to the lock 34. The second restricting surface 37 restricts a relative displacement of the resilient detecting portion 50 in the direction opposite to the riding direction on the lock projection 62 with respect to the lock 34.

According to this configuration, when the connection detecting member 45 at the initial position is pushed toward the detection position and the resilient detecting portion 50 butts against the lock 34, even if the resilient detecting portion 50 is going to be displaced in the riding direction on the lock projection with respect to the lock 34, such a displacement is impeded by the first restricting surface 36. Further, when the resilient detecting portion 50 is going to displace opposite to the riding direction on the lock projection 62 with respect to the lock 34, such a displacement is impeded by the second restricting surface 37. Thus, the connection detecting member 45 is held at the initial position.

Further, with the connection detecting member 45 held at the initial position, the first clearance 57 is secured between the first restricting surface 36 and the resilient detecting portion 50. According to this configuration, when the male housing 10 and the female housing 60 are connected properly, the lock 34 can be locked to the lock projection 62 by a resilient restoring force of the lock arm 31 without causing the first restricting surface 36 to interfere with the resilient detecting portion 50.

The first restricting surface 36 is inclined with respect to the moving direction of the connection detecting member 45 between the initial position and the detection position. According to this configuration, even if the resilient detecting portion 50 contacts the first restricting surface 36 when the male housing 10 and the female housing 60 are connected properly, the lock 34 can be locked to the lock projection 62 while causing the first restricting surface 36 to slide in contact with the resilient detecting portion 50 by a resilient restoring force of the lock arm 31.

Further, with the connection detecting member 45 held at the initial position, the second clearance 58 is secured between the second restricting surface 37 and the resilient detecting portion 50. According to this configuration, the lock 34 can ride on the lock projection 62 without causing the second restricting surface 37 to interfere with the resilient detecting portion 50 while connecting the male housing 10 and the female housing 60.

The second restricting surface 37 is inclined with respect to the moving direction of the connection detecting member 45 between the initial position and the detection position. Accordingly, even if the resilient detecting portion 50 contacts the second restricting surface 37 in the process of connecting the male housing 10 and the female housing 60, the lock 34 can ride on the lock projection 62 while causing the second restricting surface 37 to slide in contact with the resilient detecting portion 50.

Further, the resilient detecting portion 50 is a resiliently deformable arm cantilevered in the moving direction from the initial position to the detection position. The extending front part of the resilient detecting portion 50 serves as the butting surface 51 capable of contacting the receiving surface 35. Low rigidity portions (tip-side low rigidity portion 54 and base-end-side low rigidity portion 55) spaced apart in an extending direction of the resilient detecting portion 50 are formed in a region of the resilient detecting portion 50 between the base end and the butting surface 51.

Further, if a forward moving force strongly acts on the connection detecting member 45 at the initial position or in the riding process of the front part of the resilient detecting portion 50 on the lock projection 62, the resilient detecting portion 50 is deformed resiliently to be curved in a plan view. At this time, the resilient detecting portion 50 is bent at two locations, i.e. at the tip-side low rigidity portion 54 and the base-end-side low rigidity portion 55, and stress generated in the resilient detecting portion 50 is distributed to the two locations, i.e. the tip-side low rigidity portion 54 and the base-end-side low rigidity portion 55. Thus, the resilient detecting portion 50 is less likely to break when being resiliently deflected as compared to the case where the resilient detecting portion 50 is bent only at one location.

The invention is not limited to the above described and illustrated embodiment. For example, the following embodiments also are included in the scope of the invention.

Although the first restricting surface is inclined with respect to the moving direction of the connection detecting member in the above embodiment, the first restricting surface may be a surface parallel to the moving direction of the connection detecting member.

Although the second restricting surface is inclined with respect to the moving direction of the connection detecting member, the second restricting surface may be a surface parallel to the moving direction of the connection detecting member.

Although the receiving surface of the lock (facing surface of the lock facing the resilient detecting portion) has a projecting wedge shape and the butting surface of the resilient detecting portion (facing surface of the resilient detecting portion facing the lock) has a recessed triangular shape in the above embodiment, the butting surface may have a projecting wedge shape and the receiving surface may have a recessed triangular shape.

Although the receiving surface and the butting surface have a triangular shape in the above embodiment, the receiving surface and the butting surface may have a trapezoidal shape or a curved shape.

Although the resilient detecting portion is formed with two low rigidity portions in the above embodiment, the resilient detecting portion may be formed with one, three or more low rigidity portions.

Although the resilient detecting portion is formed with the low rigidity portions in the above embodiment, the resilient detecting portion may include no low rigidity portion.

LIST OF REFERENCE SIGNS

10 . . . male housing (first housing)
31 . . . lock arm
34 . . . lock
35 . . . receiving surface (facing surface)
36 . . . first restricting surface
37 . . . second restricting surface
45 . . . connection detecting member
50 . . . resilient detecting portion
51 . . . butting surface
55 . . . base-end-side low rigidity portion (low rigidity portion)
54 . . . tip-side low rigidity portion (low rigidity portion)
57 . . . first clearance (clearance between first restricting surface and resilient detecting portion)
58 . . . second clearance (clearance between second restricting surface and resilient detecting portion)
60 . . . female housing (second housing)
62 . . . lock projection

What is claimed is:

1. A connector, comprising:

a first housing formed with a resiliently deformable lock arm;

a second housing formed with a lock projection;

a lock formed on the lock arm and configured to ride on the lock projection as the lock arm is deformed resiliently in the process of connecting the first housing and the second housing and ride over the lock projection and be locked to the lock projection as the lock arm resiliently returns when the first housing and the second housing are connected properly;

a connection detecting member to be mounted into the first housing and movable between an initial position and a detection position;

a resilient detecting portion formed on the connection detecting member and configured to restrict a movement of the connection detecting member from the initial position toward the detection position by coming into contact with the lock and allow a movement of the connection detecting member from the initial position to the detection position by being disengaged from the lock;

a first restricting surface formed on a facing surface of the lock facing the resilient detecting portion and configured to restrict a relative displacement of the resilient detecting portion in a riding direction with respect to the lock; and a second restricting surface formed on the facing surface and configured to restrict a relative displacement of the resilient detecting portion in a direction opposite to the riding direction with respect to the lock.

2. The connector of claim 1, wherein a clearance is secured between the first restricting surface and the resilient detecting portion with the connection detecting member held at the initial position.

3. The connector of claim 2, wherein the first restricting surface is inclined with respect to a moving direction of the connection detecting member between the initial position and the detection position.

4. The connector of claim 3, wherein a clearance is secured between the second restricting surface and the resilient detecting portion with the connection detecting member held at the initial position.

5. The connector of claim 4, wherein the second restricting surface is inclined with respect to a moving direction of the connection detecting member between the initial position and the detection position.

6. The connector of claim 5, wherein:

the resilient detecting portion is in the form of a resiliently deformable arm cantilevered in a moving direction from the initial position to the detection position;

an extending end part of the resilient detecting portion serves as a butting surface capable of coming into contact with the facing surface; and low rigidity portions spaced apart in an extending direction of the resilient detecting portion are formed in a region of the resilient detecting portion between a base end part and the butting surface.

7. The connector of claim 1, wherein the first restricting surface is inclined with respect to a moving direction of the connection detecting member between the initial position and the detection position.

8. The connector of claim 1, wherein a clearance is secured between the second restricting surface and the resilient detecting portion with the connection detecting member held at the initial position.

9. The connector of claim 1, wherein the second restricting surface is inclined with respect to a moving direction of the connection detecting member between the initial position and the detection position.

10. The connector of claim 1, wherein:

the resilient detecting portion is in the form of a resiliently deformable arm cantilevered in a moving direction from the initial position to the detection position;

an extending end part of the resilient detecting portion serves as a butting surface capable of coming into contact with the facing surface; and low rigidity portions spaced apart in an extending direction of the resilient detecting portion are formed in a region of the resilient detecting portion between a base end part and the butting surface.

* * * * *